United States Patent [19]

Beck et al.

[11] Patent Number: 4,584,852

[45] Date of Patent: Apr. 29, 1986

[54] COMPOUND NEEDLE FOR A KNITTING MACHINE

[75] Inventors: Ernst Beck, Bitz; Alfred Durst; Heinz Merk, both of Albstadt; Schuler Bernhard, Sonnenbühl; Kurt Wiedenhöfer; Werner Wohlgemuth, both of Albstadt, all of Fed. Rep. of Germany

[73] Assignees: Theodor Groz & Sohne; Ernst Beckert Nadelfabrik Commandit-Gesellschaft, both of Albstadt-Ebingen, Fed. Rep. of Germany

[21] Appl. No.: 630,079

[22] Filed: Jul. 12, 1984

[30] Foreign Application Priority Data

Jul. 16, 1983 [DE] Fed. Rep. of Germany ..... 3325767

[51] Int. Cl.[4] ..... D04B 35/02

[52] U.S. Cl. ..... 66/120; 66/116; 66/123

[58] Field of Search ..... 66/116, 120, 62, 13, 66/123

[56] References Cited

U.S. PATENT DOCUMENTS

| | | | |
|---|---|---|---|
| 3,584,481 | 6/1971 | Hayashi | 66/123 |
| 4,109,490 | 8/1978 | Bosch | 66/120 |

FOREIGN PATENT DOCUMENTS

| | | | |
|---|---|---|---|
| 1635847 | 4/1973 | Fed. Rep. of Germany . | |
| 2705605 | 8/1977 | Fed. Rep. of Germany . | |
| 1088820 | 12/1954 | France | 66/120 |
| 93971 | 10/1970 | German Democratic Rep. . | |
| 477746 | 5/1968 | Japan | 66/120 |
| 2070075 | 9/1981 | United Kingdom | 66/120 |

*Primary Examiner*—Ronald Feldbaum
*Assistant Examiner*—Mary A. Ellis
*Attorney, Agent, or Firm*—Frishauf, Holtz, Goodman & Woodward

[57] ABSTRACT

A compound needle for a knitting machine has a machine shank of substantially rectangular cross section, in which a substantially U-shaped longitudinal groove open at the top is formed. A closing slider adapted to fit the cross section of the groove is guided in the groove in a longitudinally slidable manner, and the groove has at least one slit leading to the outside, which extends parallel to the longitudinal axis of the groove.

In order to attain satisfactory removal of fluff or lint from the longitudinal groove, on the one hand, and to assure sufficient stability and resistance to transverse bending of the needle on the other, the longitudinal groove is closed on its top, at least partially, in the vicinity of the recess by means of a rib which also forms a guide for the slider.

20 Claims, 19 Drawing Figures

I
III
IV

COMPOUND NEEDLE FOR A KNITTING MACHINE

The invention relates to a compound needle for a knitting machine, having a needle shank of substantially rectangular cross section. A substantially U-shaped longitudinal slot that opens upward is formed in the shank, and a closing element formed to correspond to the cross section of the slot is guided in the slot in a longitudinally displaceable manner. The slot has at least one recess or slit leading to the outside and extending parallel to the longitudinal axis of the slot.

BACKGROUND

In knitting operations, especially when yarns of natural fibers, such as cotton, which have a marked tendency to produce lint or fluff, are used, the danger exists that the fluff will stick in the area of the longitudinal slot over the course of time, thereby impeding the freedom of movement of the closing element and preventing the proper operation of the compound needle.

For this reason, in a known compound needle (see German Democratic Republic Pat. No. 93 971, to which British No. 1,347,154 corresponds), a lengthwise opening or slit extending parallel to the longitudinal axis of the slot is located in the bottom surface of the longitudinal slot, so that fluff entering the longitudinal slot can escape through this opening, or slit, thereby preventing jamming of the closing element caused by an accumulation of lint or fluff in the slot. The closing element, which executes a reciprocating movement relative to the needle shank, here performs a cleaning function; that is, in its longitudinal sliding movement it repeatedly carries any fluff located in the slot into the area of the recess or slit and thereby removes it from the longitudinal slot. In order to assure proper guidance of the closing element in the longitudinal slot or groove and to prevent the closing element from being lifted away from the bottom of the longitudinal slot as a result of the force exerted upon it by the yarn, two cross pins are inserted into the side portions of the needle shank defining the longitudinal slot, ahead and behind the opening or slit; these pins extend through associated slots in the closing element. However, since the longitudinal slot or groove is open at the top over its entire length, the lateral stability of this needle is limited, particularly in the area of the opening or slit. If the needle hook is pulled to the side, for instance by lateral forces exerted as the goods are dropped, the danger therefore exists that the closing element will jam in the slot, or in moving toward the needle hook will slide past the hook, with the result that the newly formed loop will not be cast off over the end of the closing element and the needle hook but will become caught in the open needle hook instead, causing flaws in the goods.

Other compound needles, on the other hand, have great stability; such needles have the longitudinal slot or groove closed by elongated guidance elements, acting as stop parts for the butt of the closing element and attached to the edges of the longitudinal groove or slot in the interior of the needle shank by welding, riveting or the like (German Pat. No. 27 05 605, to which U.S. Pat. No. 4,109,490 corresponds). The same is true of still another compound needle (German Pat. No. 1 635 847), in which the needle shank is formed, over a portion of its length, as a tubular section encompassing the compound slider element. In these compound needles, no opening for removing fluff was provided, for the sake of needle stability. The danger that fluff or lint could stick in the vicinity of the closed longitudinal groove over the course of time when working with cotton yarn, for instance, must simply be taken into account with these needles.

Finally, still other compound needles are known (from Swiss Pat. No. 215 641) in which the longitudinal slot or groove disposed in the needle shank is open toward the back of the shank over the entire length of the slit, as far as the area of the cheek taper in the immediate vicinity of the needle hook. On the side remote from the back of the shank, there is a groove-like opening, permitting the passage therethrough of the closing element, only in the area of the needle cheek. In these compound needles, the shank is laterally unstable precisely in the vicinity of the hook, because of the groove-like opening, and thus these needles can withstand only relatively slight lateral forces.

THE INVENTION

It is an object of the invention to devise a compound needle which on the one hand is highly stable and is therefore capable of withstanding large forces, particularly those engaging the hook from the side, without an impairment of its function and in which on the other hand satisfactory removal of fluff from the longitudinal slot is assured, so that even when threads or yarns with a marked tendency to form lint or fluff are being used, problem-free operation is assured over long periods of operation.

Briefly, the longitudinal groove or slot of the compound needle is at least partially closed at its top by a guide rib in the area of the fluff removal opening or slit. It has been found that as a rule, sufficient stability is attained if the length of the guide rib amounts to only one-fifth, preferably somewhat more, of the length of the recess.

Fluff entering into the longitudinal slot is removed to the outside quite well via the opening or slit. At the same time, however, because the guide rib is disposed precisely in the area of the opening, great rigidity and therefore lateral stability of the shank is attained.

The recess may be disposed in the bottom of the longitudinal groove, as known per se, but it may also be disposed such that it is provided in only one side face of the longitudinal groove, or else openings may be disposed in both side faces of the groove or slot. In the latter case, the slits or openings facing one another may also be disposed offset from one another laterally in the longitudinal direction of the slot, which is desirable for stability. The opposing slits or openings may also be so located that they overlap one another at least partially.

In practice it has proven desirable for the guide rib to be positioned symmetrically with respect to the particular opening associated with it. The rib can be rigidly joined at both sides to the portions of the shank defining the longitudinal groove and formed-on there, for instance in a unitary or one-piece structure. In an alternative form of embodiment, the guide rib is formed-on on only one of the portions of the shank defining the longitudinal groove, for instance with this shank portion being rolled over the groove or slot in the vicinity of its upper edge. Manufacturing of the needle is facilitated if the guide rib is formed in two parts, one part each being provided on a shaft side portion defining the longitudinal slot, and the two parts located extending parallel to one another at their free longitudinal edges. The two-part guide rib can be formed by rolling over opposite side portions of the shank defining the groove. The rib elements formed-on on the two walls of the side portions act not only as guide elements for the closing element, but simultaneously as reinforcing ribs, thereby increasing the stability of the compound needle.

DRAWINGS

DETAILED DESCRIPTION

Figures 1, 2, 3, 4:
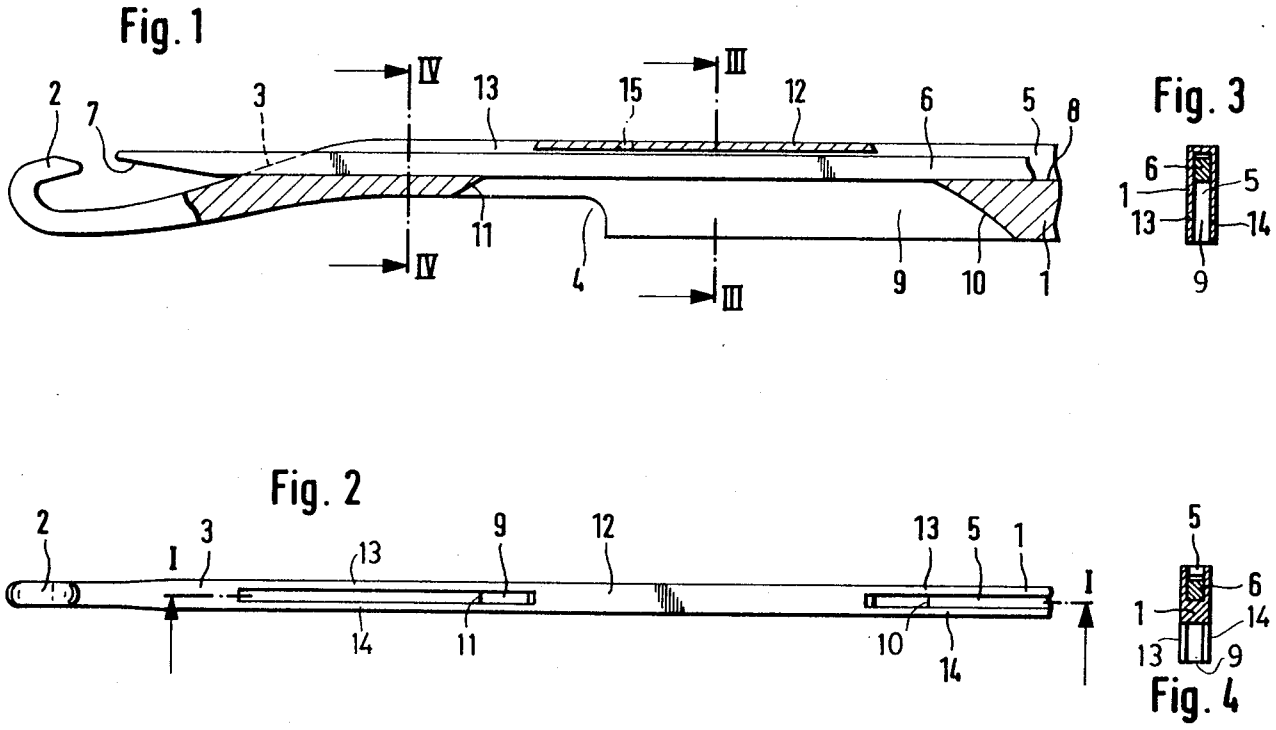
FIG. 1 shows a compound needle according to the invention, in a fragmentary side view, sectioned along the line I—I of FIG. 2.
FIG. 2 is a top plan view of the compound needle of FIG. 1 with the closing element omitted from the drawing.
FIG. 3 is a side view, sectioned along the line III—III of FIG. 1, of the compound needle of FIG. 1.
FIG. 4 shows the compound needle of FIG. 1 in a side view, sectioned along the line IV—IV of FIG. 1.

The compound needle shown in various embodiment in the drawings has in each case a needle shank 1 of substantially rectangular cross section. A needle hook 2 is joined to the needle shank at one end, via a tapered needle cheek 3. The back of the needle shank is formed at 4, with a recess extending toward the hook 2 from the vicinity of the cheek 3.

The needle shank 1, on the end remote from the needle hook 2, is shaped for insertion in a needle bed or provided with a butt intended for cooperation with a needle cam. A substantially U-shaped longitudinal slot or groove 5 is formed in shank 1. A closing element 6 in the form of a slider, adapted to the cross section of the longitudinal slot 5 is guided in the slot to be longitudinally displaceable therein. The closing element 6 is tapered on its forward end at 7, so that in the projected state it covers the tip of the needle hook 2 and can thereby close the needle hook. The closing element 6 has a butt of known design, not otherwise shown in the drawing, which protrudes beyond the periphery of the longitudinal slot 5 and is capable of cooperating with a corresponding cam race.

In the form of embodiment shown in FIGS. 1–4, an oblong slit-shaped opening 9, defining a slit, extends into, and parallel to the longitudinal axis of the slot 5. The slit 9 is defined at both ends by faces 10, 11 extending obliquely or in a slightly curved manner toward the inside of the slots and serves the purpose of removal of fluff, lint, dust and the like that has reached the interior of the longitudinal slot 5.

A thin guide element 12 is provided on the needle shank 1 facing the opening 9 and disposed symmetrically thereto, being formed-on on both sides of the side portions 13, 14 (FIG. 2) of the shank defining the longitudinal slot 5, in order to provide a unitary, one-piece structure. The closing element 6 is guided in a longitudinally displaceable manner in the longitudinal groove by the guide rib element 12 which forms a guide rib, in common with the bottom surface 8 and the inside surfaces of the side portions 13, 14 facing the longitudinal groove or slot 5. At the same time, the guide rib 12 assures great stability of the needle shank 1 even in the vicinity of the weakened zone brought about by the opening 9.

In order to attain satisfactory guidance of the closing element 6 and sufficient stability of the needle shank 1, experience has shown that it is sufficient for the length of the guide rib to be at least equal to one-fifth the length of the recess defined by the slit 9.

In the exemplary embodiment shown in FIGS. 1–4, only a single uninterrupted guide rib is disposed above the opening 9; other forms of embodiment are also conceivable in which this guide rib 12 is divided into a plurality of partial ribs, disposed one behind the other and separated from one another by intervening spaces, one of which is indicated in dashed lines at 15 and seen also as a break in the hatching of rib 12.

Figure 6:
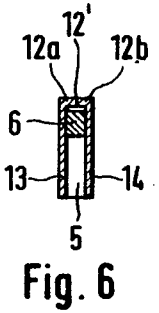
FIG. 6 shows the compound needle of FIG. 5 in a side view sectioned along the line IV—IV of FIG. 5.
Figure 5:
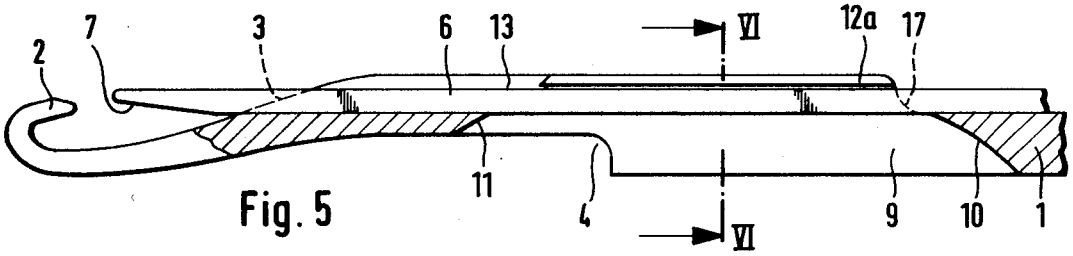
FIG. 5 shows a modified form of embodiment of the compound needle of FIG. 1, in a sectional view corresponding to FIG. 1.
Figure 7:
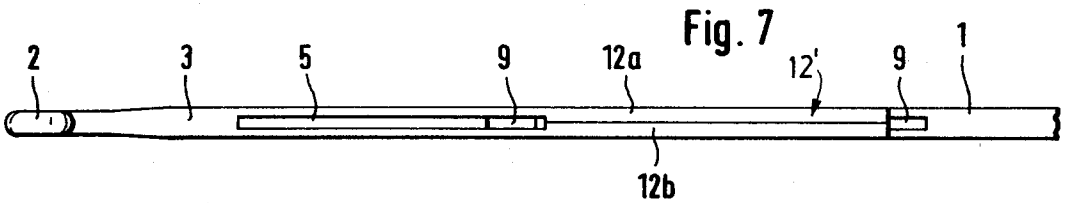
FIG. 7 shows the compound needle of FIG. 5 in a plan view, with the closing element not shown in the drawing.

The form of embodiment shown in FIGS. 5–7 corresponds substantially to that of FIGS. 1–4. Identical reference numerals indentify identical elements which need not be described again. While in the exemplary embodiment of FIGS. 1–4 the guide rib 12 is formed-on in one piece with the two side portions 13, 14 of the shank 1 by milling out the slit 9 from the direction of the back of the shank, in the form of embodiment shown in FIGS. 5–7 the arrangement is such that the guide rib 12' is formed by two parts **12*a*, 12*b*, each of which is formed-on to that side portion of the shank of the two side portions defining the longitudinal groove or slot 5, associated with that part 12*a* or 12*b* by means of bending over or rolling over the side portions 13, 14 at right angles in the area of their upper edges. The two side portions 13, 14 terminates at the back end of the guide rib 12', at 17, while in the form of embodiment shown in FIGS. 1–4 they extend over a greater portion of the length of the needle shank 1 adjoining the guide rib 12. The bent-over part of the respective side portion 13, 14**, which then forms the guide rib, together with the straight part of the side portion, defines a structural angle section.

Instead of the embodiment having two guide rib parts 12*a*, 12*b* which are disposed extending parallel to one another on their free longitudinal edges, a form of embodiment is also conceivable in which only one of the side portions 13 or 14 is bent over or rolled over with the bent-over part to form a guide rib 12 overlapping the longitudinal groove or slot 5 preferably over its entire width.

The needle shank 1 of the above-described forms of embodiment of the compound needle may also have a plurality of openings or slits 9 disposed one behind the other, with an associated guide rib 12.

Figures 8, 9, 10, 11, 12, 13:
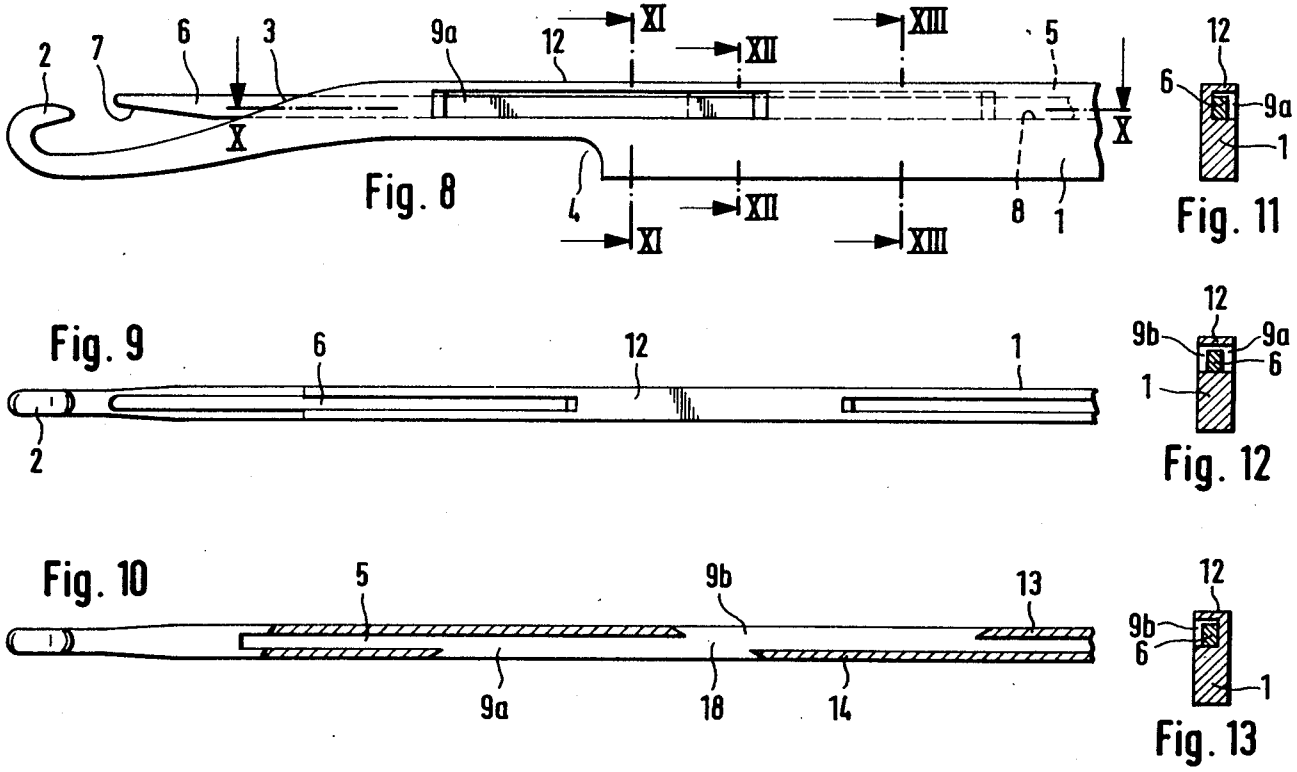
FIG. 8 shows a compound needle according to the invention in another form of embodiment, in a fragmentary side view.
FIG. 9 is a plan view of the compound needle of FIG. 8.
FIG. 10 is a plan view of the compound needle of FIG. 9, sectioned along the line IX—IX of FIG. 8, with the closing element not shown in the drawing.
FIG. 11 shows the compound needle of FIG. 1, in a side view sectioned along the line XI—XI of FIG. 1.
FIG. 12 shows the compound needle of FIG. 1, in a side view sectioned along the line XII—XII of FIG. 1.
FIG. 13 shows the compound needle of FIG. 8, in a side view sectioned along the line XIII—XIII of FIG. 8.
Figure 14:
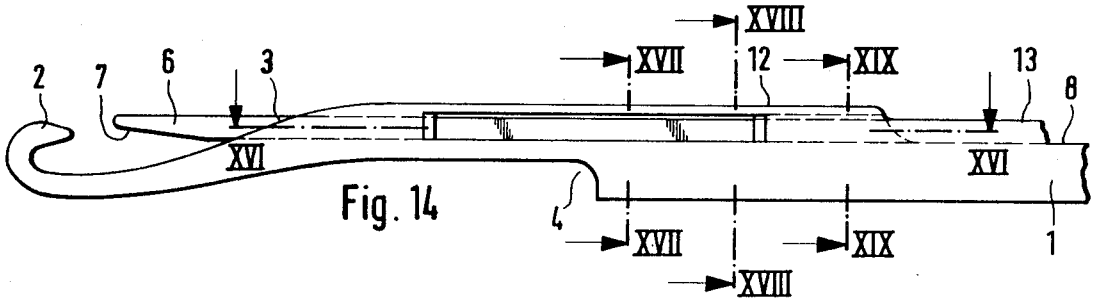
FIG. 14 is a fragmentary side view of a compound needle according to the invention, in a further form of embodiment.
Figure 15:
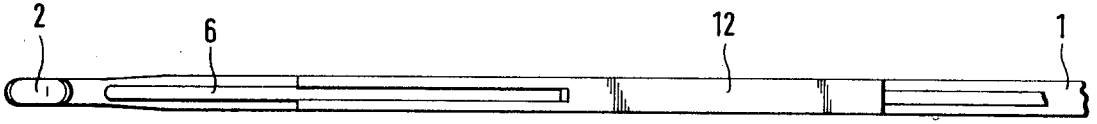
FIG. 15 is a plan view of the compound needle of FIG. 14, with the closing element omitted from the drawing.
Figure 16:
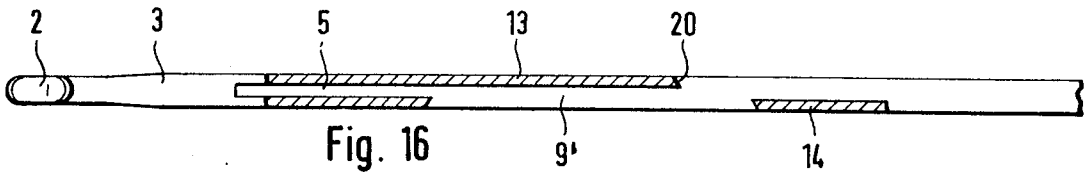
FIG. 16 shows the compound needle of FIG. 14 in a plan view, sectioned along the line XVI—XVI of FIG. 14 and with the closing element omitted from the drawing.
Figure 17:
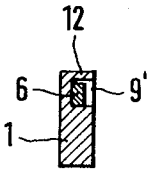
FIG. 17 shows the compound needle according to FIG. 14, in a side view sectioned along the line XVII—XVII of FIG. 14.
Figure 18:
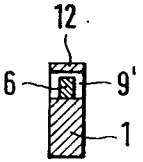
FIG. 18 shows the compound needle of FIG. 14, sectioned along the line XVIII—XVIII of FIG. 17.
Figure 19:
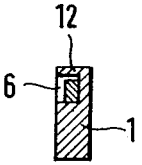
FIG. 19 shows the compound needle of FIG. 14, in a side view sectioned along the line XIX—XIX of FIG. 14.

In the forms of embodiment shown in FIGS. 8–9, in which once again, elements identical to those in forms of embodiment already described above are identified by identical reference numerals and will not be described again, the recess or slit leading to the outside from the longitudinal slot or groove 5 is provided not in the bottom surface 8 of the longitudinal groove 5, but rather in one or both of the side faces of that groove 5.

In the form of embodiment according to FIGS. 8–13, the arrangement is such that one oblong slit-like opening or slit 9*a* or 9*b* is disposed, parallel to the longitudinal axis of the slot 5, in each of the two side portions 13, 14 defining the longitudinal slot 5. Both slits 9*a*, 9*b* are disposed offset with respect to one another in the longitudinal direction of the shank, as shown in FIG. 10, and overlap one another only in the area marked 18. The longitudinal slot 5 is closed by the guide rib 12 on the end remote from the back of the needle shank and is formed-on on the two side portions 13, 14 to provide a one-piece structure and disposed symmetrically to the two openings 9*a*, 9*b* in such a manner that its central axis coincides with the central axis of the overlapping area 18.

In principle, it would be conceivable in this form of embodiment as well to assign each of the openings 9*a*, 9*b* its own guide rib 12, which in that case would be provided above the associated opening 9*a* or 9*b*, and optionally symmetrically thereto.

The two slits 9*a*, 9*b* each extend as far as the bottom surface 8 of the longitudinal slot 5, so that an uninterrupted, smoothly graduated surface is provided for the escape of any fluff or lint that may have reached the interior of the longitudinal slot 5.

In the form of embodiment shown in FIGS. 14–19, only one lateral slit 9' is provided, while on the opposite side the side portion 13 of the needle shank limiting the longitudinal slot 5 terminates in the vicinity of the guide rib 12, so that the longitudinal groove or slot 5 is open on this end adjacent to the side portion 13. Alternatively, the side portion 13, like the opposing side portion 14, may naturally extend over a greater portion of the needle shank 1.

What is claimed is:

1. Compound needle for a knitting machine comprising a needle shank (1) which, in cross section, is essentially rectangular, the needle shank (1) being formed with a groove or slot (5) of essentially U-shaped cross section;

a slider closing element (6) located in the groove or slot having a size and cross section to fit within the groove or slot and longitudinally slidable therein;

a slit-shaped opening (9) extending at least in part parallel to the groove or slot (5) and in communication therewith to permit escape and removal of fluff or other contaminants from the groove or slot being formed in the shank; and a guide rib (12) aligned, at least in part, with the slit-shaped opening (9) and at least partly overlapping the groove or slot (5), extending in longitudinal direction along the needle and, at least in part, over the slider closing element (6) to provide guidance for the slider in the groove or slot in the region of the slit-shaped opening (9), provide for stiffness of the needle in the region of the slit-shaped opening, and resistance against bending thereof when the needle is in use.

2. Compound needle according to claim 1, wherein the length of the guide rib (12) is at least one-fifth of the length of the slit (9).

3. Compound needle according to claim 1, wherein the slit-shaped opening comprises a slit (9) located in the bottom surface or base (8) of the longitudinal groove or slot (5).

4. Compound needle according to claim 1, wherein the slit (9) is disposed on one side face of the longitudinal slot or groove (5).

5. Compound needle according to claim 1, wherein the slit (9) is disposed on only one side face of the longitudinal slot or groove (5).

6. Compound needle according to claim 1, wherein the slit comprises a plurality of slit portions (9*a*, 9*b*) disposed on both side faces of the longitudinal slot or groove (5).

7. Compound needle according to claim 6, wherein the slit portions (9*a*, 9*b*) on opposite side faces are longitudinally offset, or staggered, in the longitudinal direction of the slot or groove (5).

8. Compound needle according to claim 6, wherein the slit portions (9*a*, 9*b*) on opposite side faces are disposed at least partly overlapping one another.

9. Compound needle according to claim 1, wherein the guide rib (12) is located symmetrically with respect to the slit (9) associated with it.

10. Compound needle according to claim 1, wherein the shank (1) in the region of the groove or slot (5) defines two shank side portions (13, 14); and the guide rib (12) is rigidly joined on both shank side portions (13, 14).

11. Compound needle according to claim 10, wherein the guide rib (12) is unitary with on the two side portions (13, 14) to provide a unitary, one-piece needle structure.

12. Compound needle according to claim 1, wherein the guide rib (12) is unitary with only one of the side portions (13 or 14) defining the longitudinal groove (5) to provide a unitary, one-piece structure.

13. Compound needle according to claim 1, wherein the guide rib (12') is formed in two parts, each part being unitary with a respective side portion (13, 14) defining the longitudinal groove (5) to provide a unitary, one-piece structure; and the two parts (12*a*, 12*b*) extend parallel to one another and are formed with facing longitudinal edges.

14. Compound needle according to claim 3, wherein the length of the guide rib (12) is at least one-fifth of the length of the recess or slit (9).

15. Compound needle according to claim 4, wherein the length of the guide rib (12) is at least one-fifth of the length of the recess or slit (9).

16. Compound needle according to claim 12, wherein the length of the guide rib (12) is at least one-fifth of the length of the recess or slit (9).

17. Compound needle according to claim 13, wherein the length of the guide rib (12) is at least one-fifth of the length of the recess or slit (9).

18. Compound needle according to claim 13, wherein the slit (9) is located in the bottom surface or base (8) of the longitudinal groove or slot (5).

19. Compound needle according to claim 13, wherein the recess (9) is located on one side face of the longitudinal slot or groove (5).

20. Compound needle according to claim 1, wherein the shank (1) in the region of the groove or slot (5) defines two shank side portions (13, 14);

and the guide rib comprises an end portion of at least one of said shank side portions, bent-over at an essentially right angle, said groove or slot (5) towards the center of the shank and hence a facing side portion to form, with the respective side portion, a structural angle section.

* * * * *